United States Patent [19]

Das et al.

[11] 4,179,346

[45] Dec. 18, 1979

[54] SELECTIVE USE OF WETTABLE AND NON-WETTABLE GRAPHITE ELECTRODES IN ELECTROLYSIS CELLS

[75] Inventors: Subodh K. Das, Apollo; Paul J. Boget, Murrysville, both of Pa.

[73] Assignee: Aluminum Company of America, Pittsburgh, Pa.

[21] Appl. No.: 15,303

[22] Filed: Feb. 26, 1979

[51] Int. Cl.[2] ..... C25C 3/06

[52] U.S. Cl. ..... 204/67; 204/245

[58] Field of Search ..... 204/67, 294, 243 R

[56] References Cited

U.S. PATENT DOCUMENTS

| | | | |
|---|---|---|---|
| 3,725,222 | 4/1973 | Russell et al. | 204/67 |
| 3,755,099 | 8/1973 | Haupin | 204/67 |
| 3,822,195 | 7/1974 | Dell et al. | 204/67 |
| 4,121,983 | 10/1978 | Kimosz et al. | 204/67 |

*Primary Examiner*—Howard S. Williams

*Attorney, Agent, or Firm*—Carl R. Lippert

[57] ABSTRACT

Metal such as aluminum is produced electrolytically from metal chlorides or other halides dissolved in a molten solvent bath of higher decomposition potential in a cell including one or more carbonaceous or graphite cathode surfaces spaced from opposed anodes, particularly a bipolar cell, with bath flow through the spaces between the anodes and cathodes. The wetting characteristics of the graphite cathode with respect to the metal deposited there by electrolysis are selectively balanced with the bath flow over the cathode and with the anode-to-cathode distance. Cathode surface wear rate is substantially reduced if the surface is wettable by the metal in regions of low bath flow velocity or regions of greater anode-cathode distance. The wear rate is also reduced by using a non-wettable cathode surface in regions of higher bath flow velocity or regions of closer anode-cathode distance.

21 Claims, 3 Drawing Figures

SELECTIVE USE OF WETTABLE AND NON-WETTABLE GRAPHITE ELECTRODES IN ELECTROLYSIS CELLS

BACKGROUND

This invention relates to the production of metal such as aluminum from metal chloride dissolved in molten halide solvent bath by electrolyzing the bath in a monopolar or bipolar cell. More particularly, the invention relates to carbonaceous or graphite electrodes used in such cells and to selective use thereof with respect to their wetting or non-wetting characteristics so as to prolong useful electrode life in such cells.

One type of electrolytic cell used in the production of metal, such as aluminum, from metal chloride dissolved in a solvent salt bath includes a terminal anode, at least one intermediate bipolar electrode and a terminal cathode. These electrodes are typically situated in relatively closely spaced, generally parallel relationship wherein opposed anode-cathode faces provide interelectrode spaces through which the molten bath can move and be electrolyzed by passage of current from anode to cathode. Electrolysis of the metal chloride occurring within the interelectrode space results in molten metal depositing at the cathode and chlorine gas collecting at the anode. Cells of this type are described in U.S. Pat. Nos. 3,755,099 and 3,822,195, incorporated herein by reference. One of the important features of these cells is that the anode-to-cathode space or distance should be carefully maintained at a preselected level in order to achieve the high current efficiency and lower power consumption capabilities of the bipolar chloride electrolysis process. Obviously, any amount of wear occurring on either the anode or the cathode surface, as by erosion or other removal of electrode material tends to increase the distance and, accordingly, increase the electrical resistance across the distance between anode and cathode. For the most part, the anode presents little problem since under most conditions chlorine is relatively non-corrosive to the carbonaceous materials employed for electrodes. However, experience has shown that some amount of electrode wear does occur on the cathode surface, and considerable effort has been expended to reducing or relieving this wear condition. Excessive cathode surface wear is a problem, not only in increasing power consumption, as just explained, but can increase the resistance so much that the cell is considered uneconomical to operate, thus necessitating a costly shutdown, repair or replacement of the electrodes, and restarting the cell. In addition to the electrical resistance problems resulting from cathode wear, the carbonaceous material removed from the cathode surface can contaminate the bath. This alone can reach such an extreme as to necessitate shutting down the cell.

SUMMARY OF THE INVENTION

In accordance with the invention, it has been discovered that graphite electrode surfaces can exhibit either wetting or non-wetting behavior with respect to the metal deposited at the cathode, and that such behavior can be utilized in association with bath flow velocity and anode-cathode distance to minimize cathode surface wear.

Accordingly, it is an object of the present invention to provide for decreased cathode electrode wear in halide electrolytic cells used in producing metal such as aluminum from metal chlorides.

Another object is to provide a means for selectively positioning graphite cathode material based on its wetting characteristics so as to balance such with other cell operating conditions to minimize cathode wear.

These and other objects will be apparent from the drawing, specification and claims appended hereto.

In accordance with the invention, it has been found that graphite cathode surface wear is reduced if the cathode surface is selected and controlled with respect to its wettability and with respect to the bath flow rate over the cathode surface. Cathode graphite surfaces wetted by the metal deposited from the bath are used where the bath is moving over the cathode at a relatively low velocity. However, graphite cathode surfaces which are not wetted are used in regions of high velocity bath flow. It is to be appreciated that in electrolytic cells of the type here concerned, bath flow velocity can vary from cell to cell and within a single cell. Thus, in some electrolytic cells the bath flow velocity through the anode-cathode interelectrode space is relatively slow and in others it is more rapid. Moreover, there are cells which include regions wherein each effect occurs. In general, in the electrolytic cells of the type depicted herein and in the patents above referred to featuring one or more horizontal bipolar electrodes between an upper terminal anode and a lower terminal cathode providing more or less horizontal bath flow therebetween, it is difficult to avoid the occurrence of both fast and slow regions. In these cells a more rapid interelectrode bath flow velocity can occur in the upper interelectrode spaces and a lower flow velocity can occur in lower interelectrode spaces. Hence, one practice of the invention includes in a single electrolytic cell the use of non-wettable cathode surfaces in regions of the cell where the higher flow rates occur, typically regions higher or further away from the terminal cathode and the use of wettable cathode surfaces in regions where low flow rates occur, typically regions lower or closer to the terminal cathode.

DETAILED DESCRIPTION OF THE INVENTION

Electrolytic Cell

Figure 1:
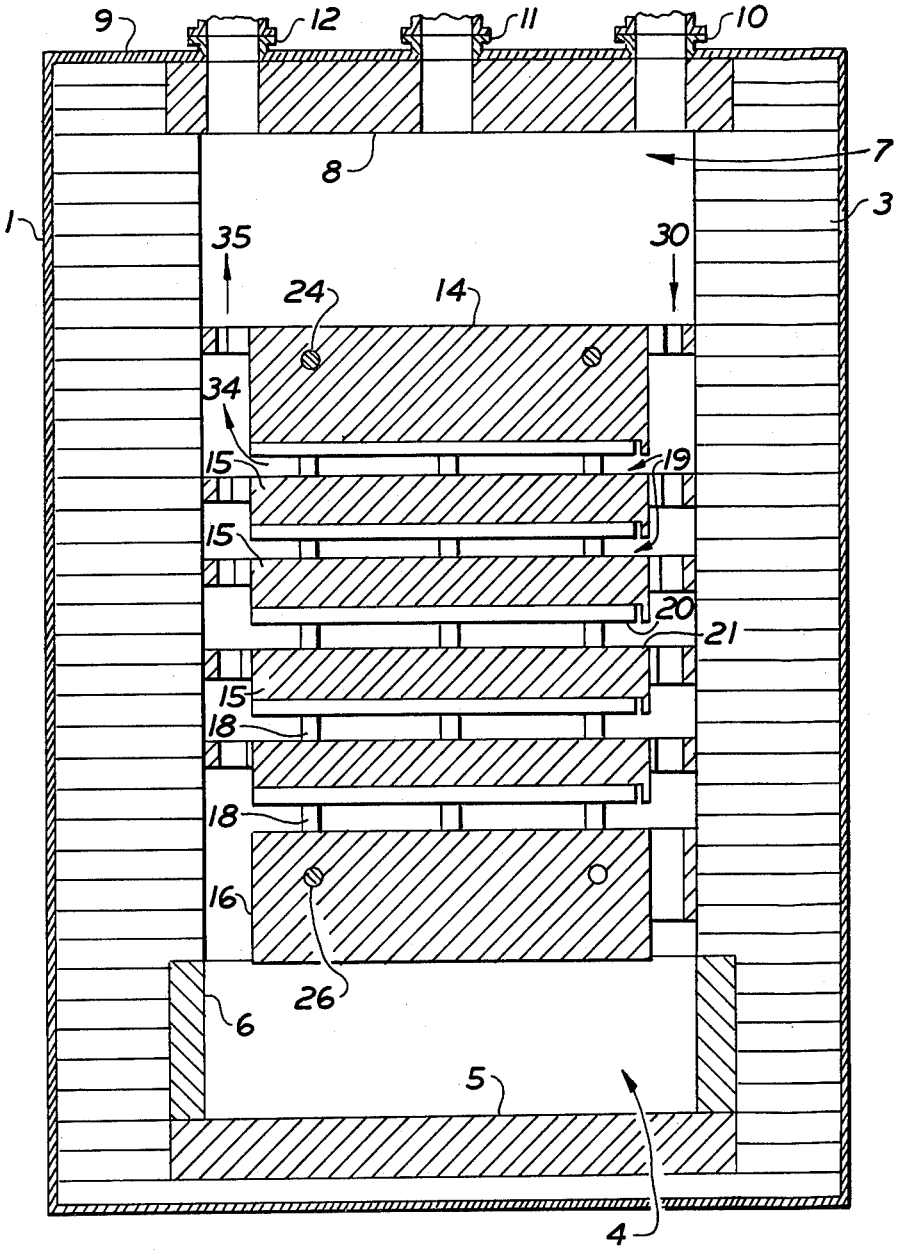
FIG. 1 is a sectional elevation illustrative of a cell for producing aluminum or other metal in accordance with the invention.

A suitable cell structure for producing metal in accordance with the invention is illustrated in FIG. 1. The cell illustrated includes an outer steel shell 1, which is lined with refractory sidewall and end wall brick 3, made of thermally insulating, electrically non-conductive material which is resistant to molten alkali metal and metal chloride-containing halide bath and the decomposition products thereof. The cell cavity includes a sump 4 in the lower portion for collecting the metal produced. The sump bottom 5 and walls 6 are preferably made of graphite. The cell cavity also accommodates a bath reservoir 7 in its upper zone. The cell is enclosed by a refractory roof 8, and a lid 9. A first port 10, extending through the lid 9 and roof 8, provides for insertion of a vacuum tapping tube down into sump 4, through an internal passage to be described later, for removing molten metal from the sump. A second port 11 provides inlet means for feeding the metal chloride into the bath. A third port 12 provides outlet means for venting chlorine.

Within the cell cavity are a plurality of plate-like electrodes which include an upper terminal anode 14, desirably an appreciable number of bipolar electrodes 15 (four being shown), and a lower terminal cathode 16, all of graphite. These electrodes are shown arranged in superimposed relation, with each electrode preferably being horizontally disposed within a vertical stack. Sloping or vertically disposed electrodes can also be employed, however, in either monopolar or bipolar electrode cell arrangements. In FIG. 1, the cathode 16 is supported at each end on sump walls 6. The remaining electrodes are stacked one above the other in a spaced relationship established by interposed refractory pillars 18. Such pillars 18 are sized to closely space the electrodes, as for example to space them with their opposed surfaces separated by ¾ inch or less. In the illustrated embodiment, five interelectrode spaces 19 are provided between opposed electrodes, one between terminal cathode 16 and the lowest of the bipolar electrodes 15, three between successive pairs of intermediate bipolar electrodes 15, and one between the highest of the bipolar electrodes 15 and terminal anode 14. Each interelectrode space 19 is bounded by an upper surface 20 provided by the bottom of one electrode (which surface 20 functions as an anode surface) opposite a lower surface 21 provided by the top of another electrode (which surface 21 functions as a cathode surface). The spacing between anode and cathode surfaces is the anode-cathode distance in the absence of a metal layer of substantial thickness. When a layer of metal is present on the cathode surface, the effective anode-cathode distance is shorter than the distance between the graphite electrode surfaces 20 and 21. The bath level in the cell will vary in operation but normally will lie well above the anode 14, thus filling all otherwise unoccupied space therebelow within the cell.

Anode 14 has a plurality of electrode bars 24 inserted therein which serve as positive current leads, and cathode 16 has a plurality of collector bars 26 inserted therein which serve as negative current leads. The bars 24 and 26 extend through the cell wall and are suitably insulated from the steel shell 1. A suitable voltage is imposed across the terminal anode 14 and the terminal cathode 16, and this imparts the bipolar character to bipolar electrodes 15.

As indicated earlier, the sump 4 is adapted to contain bath and molten metal, and the latter may accumulate beneath the bath in the sump, during operation. Should it be desired to separately heat the bath and any metal in sump 4, an auxiliary heating circuit may be established therein.

A bath supply passage indicted by arrow 30 generally extends from the upper reservoir 7 down along the right-hand side (as viewed in FIG. 1) of the electrodes and into each interelectrode space 19. Thus, each of the interelectrode spaces 19 is supplied with a continual supply of the molten bath which travels across each interelectrode space 19 (moving right to left in FIG. 1) and exits the interelectrode space 19 turning upwardly as generally indicated by arrows 34 and 35.

The Molten Bath

The electrolyte employed for producing aluminum in accordance with the present invention typically comprises a molten salt bath composed essentially of aluminum chloride dissolved in one or more halides, particularly chlorides, of higher decomposition potential than aluminum chloride. By electrolysis of such a bath, chlorine is produced on the anode surfaces and aluminum on the cathode surfaces of the cell electrodes. The metal is conveniently separated by settling from the lighter bath, and the chlorine rises to be vented from the cell. In such a practice of the present invention, the molten bath may be positively circulated through the cell by the buoyant gas lift effect of the internally produced chlorine gas, and aluminum chloride is periodically or continuously introduced into the bath to maintain the desired concentration thereof.

The bath composition, in addition to the dissolved aluminum chloride, will usually be made up of alkali metal chloride, although, other alkali metal halide and alkaline earth halide, may also be employed. A presently preferred aluminum chloride containing composition comprises an alkali metal chloride base composition made up of about 50–75 percent by weight sodium chloride and 25–50 percent lithium chloride. Aluminum chloride is dissolved in such halide composition to provide a bath from which aluminum may be produced by electrolysis, and an aluminum chloride content of about 1½ to 10 percent by weight of the bath is generally desirable. As an example, a bath analysis as follows (in percent by weight) is satisfactory: 53 percent NaCl, 40 percent LiCl, 0.5 percent $MgCl_2$, 0.5 percent KCl, 1 percent $CaCl_2$, and 5 percent $AlCl_3$. In such a bath, the chlorides other than NaCl, LiCl and $AlCl_3$ may be regarded as incidenal components or impurities. The bath is employed in molten condition, usually at a temperature above that of molten aluminum and in the range between 660° and 70° C., typically at about 700° C.

Operation

As described hereinabove, bath supplied from reservoir 7 through bath supply passage 30 is electrolyzed in each interelectrode space 19 to produce chlorine on each anode surface 20 and aluminum on each cathode surface 21. Electric current applied between the upper anode 14 and the bottom cathode 16 causes the interdisposed bipolar electrodes 15 to exhibit their bipolar behavior and effect electrolysis within each interelectrode space 19. The electrode current density can conveniently range from about 5 to 15 amperes per square inch, but preferred current density can vary from one particular cell to another and is readily determined by observation.

The chlorine produced at the anode is buoyant in the bath and its movement through the bath may be employed to effect bath circulation. That is, the chlorine rising up along the left side, when viewed in FIG. 1, of the cell creates a bath circulation effect including a sweeping of the bath through the interelectrode spaces 19. This sweeping action sweeps the aluminum produced on each cathode surface through and out of each interelectrode space 19 in the same direction, as the bath, toward the left as viewed in FIG. 1, and permits the aluminum to then settle down into the sump 4.

As indicated hereinabove, the spacing between electrodes and the bath velocity through those spaces can vary from cell to cell and within a given well. For the type of cell shown in U.S. Pat. No. 3,755,099, it will usually be found that the lower zones closer to the terminal cathodes 16 exhibit a lower bath velocity through the interelectrode spaces, whereas the higher zones closer to terminal anode 14 tend to exhibit higher bath flow rates through the interelectrode spaces 19.

Electrodes

The electrodes, including the bipolar electrodes 15, are normally comprised of a carbonaceous material, preferably graphite grade carbon, which can be produced from coke derived from coal or petroleum. In the case of petroleum coke, such is typically calcined at a temperature of about 800° to 1600° C. in order to drive off volatile impurities. In making an electrode, the calcined coke is blended with a pitch binder to provide a mixture having a pitch content of about 10 to 30%. This mixture is shaped such as by extrusion to provide a suitable size and configuration for use as an electrode. A shaped member can be cut to provide two or more electrode block pieces, after which the electrode is baked at about 700° to 1600° C. to drive off volatiles from the pitch binder. The next step usually involves immersing the baked block to impregnate it with liquid pitch to increase the density, after which it is again baked at about 700° to 1600° C. The baking and pitch treatment can be repeated one or more times to further increase the density. Finally, the carbonaceous material is graphitized at a typical temperature of about 2000° to 3100° C.

Determining Wettability

Figure 3:
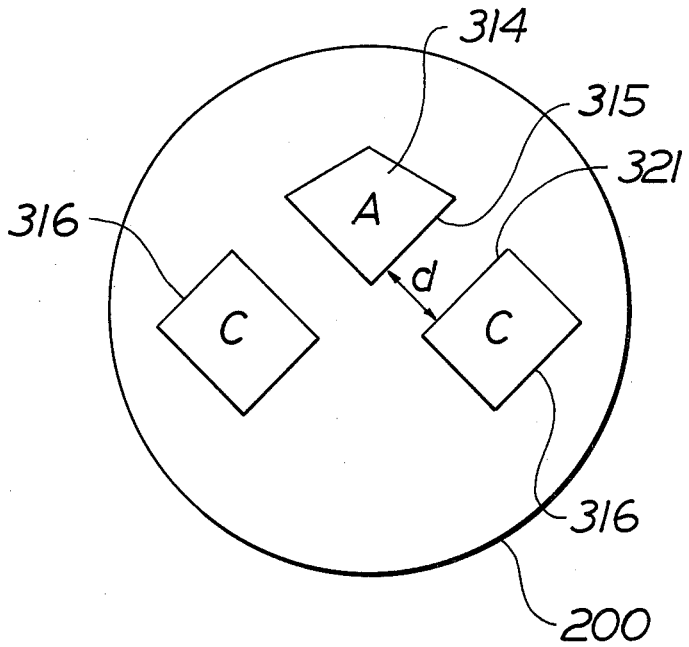
FIG. 3 is a schematic plan view of a cell of the type shown in FIG. 2.
Figure 2:
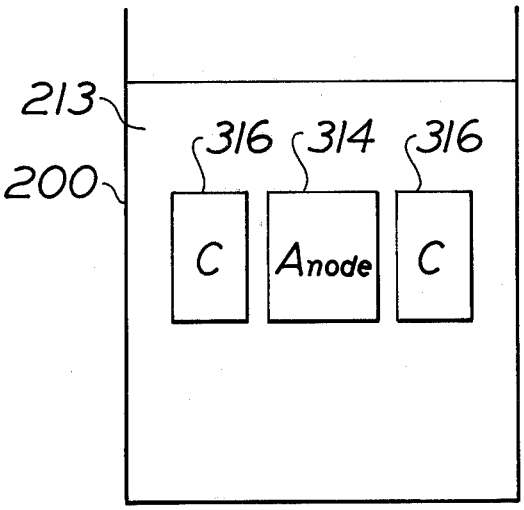
FIG. 2 is a schematic sectional elevation of an electrolytic cell useful in practicing the invention.

In accordance with the invention, the wettability of a given graphite or other carbonaceous electrode material is readily determined by a test now described. Referring to FIGS. 2 and 3, there are schematically shown convenient arrangements for determining the wettablility characteristics of electrode materials. In this type of arrangement, a small laboratory type electrolytic cell 200 has positioned therein an anode 314 together with two cathodes 316. The cathodes 316 may be identical or they may be different where it is desired to test two different electrode samples. Since the area of concern is the cathode surface, it is important that the surface 321 of the cathode 316 correspond to the cathode surface to be used in a production cell. That is, the cathode 316 should be taken from a larger electrode, or at least be representative of such material removed from a larger electrode, and be such that its surface 321 is representative of the cathode surface for the production electrode. It is also significant that the bath 213 contained within the cell 200 is preferably of substantially the same composition and temperature as anticipated in the production cell so as to minimize departures from production cell conditions.

A suitable size for the cathode blocks 316 is about 1½ inches long by ⅝ inch thick by about ¾ inch wide, and the cathodes are spaced from the anode 314 by a distance "d" which can suitably be 9/16 inch. The surface 321 should be aligned with the opposite surface 315 on the anode to be parallel and opositely facing. The cell is operated at about 710° C. at a current density of about 8 amperes per square inch. As is the case with production cells, a suitable bath contains 70% sodium chloride, 30% lithioum chloride, to which is added about 7% aluminum chloride. The aluminum chloride content is maintained by periodic or continuous addition of aluminum chloride. The operating conditions are continuously maintained for a period of about 5 days during which aluminum is made continuously.

After about 5 days, the entire bath is drained from cell 200 and the cathodes are removed. The cathode surfaces 321, i.e. those closest to and oppositely facing the anode surfaces, are examined. The largest drop or droplet of aluminum found on the cathodic surface 321 is measured as an index of wettability. If this droplet is greater than one millimeter in its largest dimension in this test, the cathodic surface is considered to be wetted by the aluminum in the electrolyte bath. If, on the other hand, the largest droplet is one millimeter or less in its major dimension, the cathodic surface 321 is considered to be non-wetting.

In the manufacture of graphitic carbonaceous electrode materials, non-wetting surface characteristics ar generally favored by the use of higher graphitization temperatures, higher crystallinity of the graphite structure, higher graphite density and by the use of acicular coke as the starting material as distinct from isotropic coke. On the other hand, wetting characteristics are generally favored by lower graphitization temperatures and lower crystallinity and density, and the use of isotropic coke as a starting material favors wetting.

Electrode Selection

As indicated hereinabove, the invention involves selection of cathode electrodes based on the wettability or non-wettability of the cathode surface in association with the electrolyte bath flow velocity over the cathode surface. The bath flow velocity is readily determined using a simulated water model of the cell, either full size or scaled down.

In accordance with the invention, cathode surfaces which exhibit wetting behavior are positioned to contact the bath where bath flow velocity over the cathode surface is relatively low, 1½ feet per seond or less, for instance 0.3 or 0.5 to 1.4 or 1.5 feet per second. These will typically be found in the lower regions in cells of the type depicted in U.S. Pat. No. 3,755,099. One practice of the invention involves the use of relatively widely spaced electrodes in the cell regions which exhibit relatively low bath flow, especially where significant amounts of aluminum can accumulate on the cathode surfaces. In these regions the electrode gap, that is the distance between the anode surface and the opposed cathode surface, can be greater than ½ inch, for instance, ⅝ to ¾ inch, although distances of up to one inch can be useful, particularly where a significant collection of molten aluminum occurs on the cathode surface, such as sometimes can occur in the lower bath portions in a cell of the type depicted in FIG. 1 and in U.S. Pat. No. 3,755,099, that is, regions of the cell closer to terminal cathode 16. One advantage in using wettable electrodes is that they can be less expensive to produce, thus reducing costs, provided such are properly employed in accordance with the invention.

In those regions of electrolytic cells where the bath flow velocity is relatively high at the cathode surface, over 1½ feet per second, for instance 1.6 to 3 feet per second, the cathode surface should be non-wetted by the aluminum depositing there from the bath. Regions of high flow typically occur in the relatively higher regions of electrolytic cells of the type depicted in FIG. 1 and in U.S. Pat. No. 3,755,099, that is, regions closer to terminal anode 14. In regions of higher bath flow velocity, a preferred practice is to use relatively closely spaced electrodes, ½ inch or less, for instance, ⅜ inch.

The practice of the invention includes the use in a single electrolytic cell of both high flow and low flow regions and the selective use of graphite electrodes in those respective regions based on the non-wettability or wettability of their cathode surfaces. Hence, one embodiment of the invention features the use of both high and low flow velocity regions in an electrolytic cell such that the bath flow between the anode and cathode in one or more interelectrode spaces 19 is relatively high, for instance greater than 1½ feet per second. That same cell also includes a lower flow rate of about 1½ feet per second or less in one or more other interelectrode spaces. The relatively high flow velocity can be 1½ or 2 or more times the relatively low flow velocity. The practice of the invention places cathodes with non-wettable surfaces in the high flow regions and one or more cathodes with wettable surfaces in the lower flow regions, all in the same cell. The use of greater anode-cathode distances for the low flow regions and lesser anode-cathode distances for the high flow regions as just described can also be employed within a single cell.

The improvement is illustrated in the following examples. In each case, the wettability was determined in accordance with the test depicted in FIGS. 2 and 3, particularly FIG. 3, and described hereinabove. The data in Table I shows cathode wear rate as it varies with graphite cathode wettability and bath flow velocity in baths containing around 70% NaCl and 30% LiCl to which is added about 7% $AlCl_3$. The baths operating at about 710° C. are electrolyzed to produce aluminum. The wear rate is determined for a measured time and converted to estimated mm. of wear per year to provide a comparative wear estimate.

Table I

| Example | Droplet Size (mm) | Wetting | Bath Velocity (ft/sec) | Wear Rate (mm/year) |
|---|---|---|---|---|
| 1 | 2.2 | wettable | <0.1 | 4.6 |
| 2 | 2.2 | wettable | 1.4 | 3.0 |
| 3 | 2.2 | wettable | 2.5 | 19.1 |
| 4 | 0.8 | non-wettable | <0.1 | 6.1 |
| 5 | 0.8 | non-wettable | 2.5 | 7.4 |

Table I illustrates the sensitivity of wettable graphite to relatively high bath flow velocity of 2.5 feet per second (Example 2) but indicates much lower wear rates for low bath flow velocities of less than 0.1 feet per second (Example 1) and 1.4 feet per second. Non-wettable graphite in this test had acceptable wear rate for either high or low flow rates but not as good as the wettable graphite under low bath flow rate conditions.

While the invention has been described with particular reference to electrolytic cells of the type shown in FIG. 1 featuring horizontal electrodes and horizontal interelectrode spaces therebetween for essentially horizontal bath flow through the interelectrode spaces, it is believed that the invention may also be useful in cells featuring non-horizontal electrodes such as vertical electrodes. In such case, the non-wettable cathode surfaces are to be used with higher velocity bath movement whereas wettable cathode surfaces are to be used in conjunction with lower bath velocity over the cathode surface.

What is claimed is:

1. A method for the production of aluminum in an electrolytic cell containing a halide of said aluminum dissolved in a molten solvent bath of higher decomposition potential, the cell including a plurality of interelectrode spaces between opposed anode and graphite cathode electrode surfaces wherein:

(a) said bath is moved through a plurality of said interelectrode spaces where said bath is electrolyzed to deposit molten aluminum at the cathode surface thereof, the bath moving through at least one first interelectrode space at a velocity of 1½ feet per second or less;

(b) said first interelectrode space being provided with a graphite cathode surface which is wetted by said aluminum produced from said bath as it is deposited at said cathode surface;

(c) such interelectrode spaces through which said bath moves through a velocity of over 1½ feet per second are provided with a graphite cathode surface which is not wetted by said aluminum produced from said bath as it is deposited at said cathode surface.

2. The method according to claim 1 wherein said halide comprises aluminum chloride.

3. The method according to claim 1 wherein the bath velocity over said wetted graphite cathode surface in said first interelectrode space is ½ to 1½ feet per second.

4. The method according to claim 1 wherein said first interlectrode space is greater than ½ inch between opposed anode and cathode surfaces.

5. The method according to claim 1 wherein such interelectrode space through which said bath moves at greater than 1½ feet per second is ½ inch or less between opposed anode and cathode surfaces.

6. The method according to claim 1 wherein a terminal anode is situated in the upper region of the electrolytic cell and a terminal cathode is in the lower region and wherein substantially horizontal bipolar electrodes therebetween define substantially horizontal interelectrode spaces between opposed anode and cathode surfaces.

7. The method according to claim 6 wherein said first interelectrode space is situated close to the terminal cathode.

8. The method according to claim 7 wherein said first interelectrode space is greater than ½ inch between opposed anode and cathode surfaces.

9. A method for the production of aluminum in an electrolytic cell containing a chloride of aluminum dissolved in a molten solvent bath of higher decomposition potential, the cell including a plurality of interelectrode spaces between spaced opposed anode and graphite cathode electrode surfaces, comprising:

(a) moving a portion of said bath through at least one first interelectrode space at a velocity of 1½ feet per second or less while electrolyzing said bath in said first interelectrode space to deposit aluminum at the graphite cathode surface for said first interelectrode space, said graphite cathode surface for said first interelectrode space being wetted by said aluminum there deposited;

(b) moving a portion of said bath through at least one second interelectrode space at a velocity of greater tha 1½ feet per second while electrolyzing said bath in said second interelectrode space to deposit aluminum at the graphite cathode surface for said second interelectrode space, said graphite cathode surface for said second interelectrode space being non-wetted by said aluminum there deposited.

10. The method according to claim 9 wherein the bath velocity over said wetted graphite cathode surface in said first interelectrode space is ½ to 1½ feet per second.

11. The method according to claim 9 wherein said first interelectrode space is greater than ½ inch between opposed anode and cathode surfaces.

12. The method according to claim 9 wherein said second interelectrode space is ½ inch or less between opposed anode and cathode surfaces.

13. The method according to claim 9 wherein a terminal anode is situated in the upper region of the electrolytic cell and a terminal cathode is in the lower region and wherein substantially horizontal bipolar electrodes therebetween define substantially horizontal interelectrode spaces between opposed anode and cathode surfaces.

14. The method according to claim 13 wherein said first interelectrode space is closer to the terminal cathode than said second interelectrode space.

15. The method according to claim 14 wherein said first interelectrode space is greater than ½ inch between opposed anode and cathode surfaces.

16. A method for the production of aluminum in an electrolytic cell containing a halide of aluminum dissolved in a molten solvent bath of higher decomposition potential, the cell including a plurality of interelectrode spaces between opposed spaced anode and graphite cathode electrode surface comprising:

(a) moving said bath through at least one such interelectrode space at a relatively low velocity, the distance between the anode and cathode surfaces defining said space being greater than ½ inch, the graphite cathode surface of said interelectrode space being wetted by said aluminum there deposited by electrolysis from said bath in said space;

(b) moving said bath through at least one such interelectrode space at a relatively high velocity, the distance between the anode and cathode surfaces defining said space being ½ inch or less, the graphite cathode surface of said interelectrode space being non-wetted by said aluminum there deposited by electrolysis from said bath in said space.

17. A method for the production of aluminum in an electrolytic cell by electrolysis of a halide of aluminum dissolved in a molten solvent bath of higher decomposition potential, the cell including a terminal anode in its upper region, a terminal cathode in its lower region, and a plurality of substantially horizontal bipolar graphite electrodes therebetween and a plurality of substantially horizontal interelectrode spaces between opposed anode and cathode electrode surfaces comprising:

(a) moving said bath through at least one first interelectrode space at a velocity of 1½ feet per second or less, said interelectrode space having a graphite cathode surface which is wetted by said aluminum;

(b) moving said bath through at least one second interelectrode space at a velocity of over 1½ feet per second, said interelectrode space having a graphite cathode surface which is nonwetted by said aluminum;

(c) said first interelectrode space being situated closer to the terminal cathode and having a greater distance separating opposed anode and cathode spaces than said second interelectrode space.

18. The method according to claim 17 wherein the bath velocity over said wetted graphite cathode surface in said first interelectrode space is ½ to 1½ feet per second.

19.The method according to claim 17 wherein said first interelectrode space is greater than ½ inch between opposed anode and cathode surfaces.

20. The method according to claim 17 wherein said second interelectrode space is ½ inch or less between opposed anode and cathode surfaces.

21. The method according to claim 17 wherein said halide comprises aluminum chloride.

* * * * *

UNITED STATES PATENT AND TRADEMARK OFFICE

CERTIFICATE OF CORRECTION

PATENT NO. : 4,179,346

DATED : December 18, 1979

INVENTOR(S) : Subodh K. Das et al

It is certified that error appears in the above-identified patent and that said Letters Patent are hereby corrected as shown below:

| | |
|---|---|
| In the References Cited: | Change "Kimosz" to --Kinosz-- |
| Col. 4, line 36 | Change "incidenal" to --incidental-- |
| Col. 4, line 39 | Change "70°C" to --730°C-- |
| Col. 4, line 68 | After "given", change "well" to --cell-- |
| Col. 5, line 61 | Change "opositely" to --oppositely-- |
| Col. 5, line 65 | Change "lithioum" to --lithium-- |
| Col. 6, line 16 | Change "ar" to --are-- |
| Col. 6, line 37 | Change "seond" to --second-- |

Signed and Sealed this

*First* Day of *April 1980*

[SEAL]

*Attest:*

*Attesting Officer*

SIDNEY A. DIAMOND

*Commissioner of Patents and Trademarks*